US005897438A

United States Patent [19]

Kunz et al.

[11] Patent Number: 5,897,438

[45] Date of Patent: Apr. 27, 1999

[54] MODULAR RINK ASSEMBLY

[76] Inventors: Joann Kunz; Kenneth R. Kunz, both of 7825 Allison Dr., Almont, Mich. 48003

[21] Appl. No.: 09/095,973

[22] Filed: Jun. 11, 1998

[51] Int. Cl.[6] ..... A63C 19/10

[52] U.S. Cl. ..... 472/90; 472/92; 52/287.1

[58] Field of Search ..... 472/88, 90, 92, 472/93, 94; 52/287.1, 272, 277; 446/127, 118, 476, 478; 62/235

[56] References Cited

U.S. PATENT DOCUMENTS

| | | | |
|---|---|---|---|
| 2,882,564 | 4/1959 | Couse et al. | 52/387.1 |
| 2,996,896 | 8/1961 | Johnson | 62/235 |
| 3,930,647 | 1/1976 | Berlemont | 472/90 |
| 4,038,834 | 8/1977 | Roberts | 472/90 X |
| 4,392,647 | 7/1983 | Golebieski | 472/90 |
| 4,497,483 | 2/1985 | Ahlgren | 472/90 |
| 5,134,857 | 8/1992 | Burley | 62/235 |
| 5,195,282 | 3/1993 | Campbell | 52/79.1 |

*Primary Examiner*—Kien T. Nguyen

[57] ABSTRACT

A modular rink assembly for facilitating the assembly of a hockey rink structure includes two sets of side boards, two sets of end boards, and corner members arrangeable into a rink forming an enclosed area for playing a game. The corner members include a rounded face and T-shaped flanges for engagement to slots in the boards near the corners of the enclosed area. In a preferred embodiment, all the side and end boards include a lengthwise upper groove to facilitate attachment of plexi-glass panels or netting to further enclose the playing area. Also provided are floor panels engageable to each other for providing a uniform playing surface.

8 Claims, 2 Drawing Sheets

MODULAR RINK ASSEMBLY

BACKGROUND OF THE INVENTION

1. Field of the Invention

The present invention relates to sporting rinks and more particularly pertains to a new modular rink assembly for facilitating the assembly of a hockey rink structure.

2 Description of the Prior Art

The use of sporting rinks is known in the prior art. More specifically, sporting rinks heretofore devised and utilized are known to consist basically of familiar, expected and obvious structural configurations, notwithstanding the myriad of designs encompassed by the crowded prior art which have been developed for the fulfillment of countless objectives and requirements.

Known prior art sporting rinks and hockey practice area devices include U.S. Pat. Nos. 5,134,857; 2,996,896; 3,986,342; 3,930,647; and PCT Patent No. WO 96/23554.

While these devices fulfill their respective, particular objectives and requirements, the aforementioned patents do not disclose a new modular rink assembly. The inventive device includes side and end wall pieces, rounded corner connectors, and inter-connectable floor board segments.

In these respects, the modular rink assembly according to the present invention substantially departs from the conventional concepts and designs of the prior art, and in so doing provides an apparatus primarily developed for the facilitating the assembly of a hockey rink structure of facilitating the assembly of a hockey rink structure.

SUMMARY OF THE INVENTION

In view of the foregoing disadvantages inherent in the known types of sporting rinks now present in the prior art, the present invention provides a new modular rink assembly construction wherein the same can be utilized for facilitating the assembly of a hockey rink structure.

The general facilitating the assembly of a hockey rink structure of the present invention, which will be described subsequently in greater detail, is to provide a new modular rink assembly apparatus and method which has many of the advantages of the sporting rinks mentioned heretofore and many novel features that result in a new modular rink assembly which is not anticipated, rendered obvious, suggested, or even implied by any of the prior art sporting rinks, either alone or in any combination thereof.

To attain this, the present invention generally comprises side and end wall pieces, rounded corner connectors, and interconnectable floor board segments.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the facilitating the assembly of a hockey rink structure of description and should not be regarded as limiting.

As such, those skilled in the art will appreciate that the conception, upon which this disclosure is based, may readily be utilized as a basis for the designing of other structures, methods and systems for carrying out the several facilitating the assembly of a hockey rink structures of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new modular rink assembly apparatus and method which has many of the advantages of the sporting rinks mentioned heretofore and many novel features that result in a new modular rink assembly which is not anticipated, rendered obvious, suggested, or even implied by any of the prior art sporting rinks, either alone or in any combination thereof.

It is another object of the present invention to provide a new modular rink assembly which may be easily and efficiently manufactured and marketed.

It is a further object of the present invention to provide a new modular rink assembly which is of a durable and reliable construction.

An even further object of the present invention is to provide a new modular rink assembly which is susceptible of a low cost of manufacture with regard to both materials and labor, and which accordingly is then susceptible of low prices of sale to the consuming public, thereby making such modular rink assembly economically available to the buying public.

Still yet another object of the present invention is to provide a new modular rink assembly which provides in the apparatuses and methods of the prior art some of the advantages thereof, while simultaneously overcoming some of the disadvantages normally associated therewith.

Still another object of the present invention is to provide a new modular rink assembly for facilitating the assembly of a hockey rink structure.

Yet another object of the present invention is to provide a new modular rink assembly which includes side and end wall pieces, rounded corner connectors, and interconnectable floor board segments.

Still yet another object of the present invention is to provide a new modular rink assembly that is easy to assemble and can be used from year to year.

Even still another object of the present invention is to provide a new modular rink assembly that prevents a ball or puck from escaping the playing area.

Even yet another object of the present invention is to provide a modular rink assembly that provides an alternative play area thus protecting items and areas such as windows, steps and garage doors, commonly used for or found near areas used by children for playing games.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
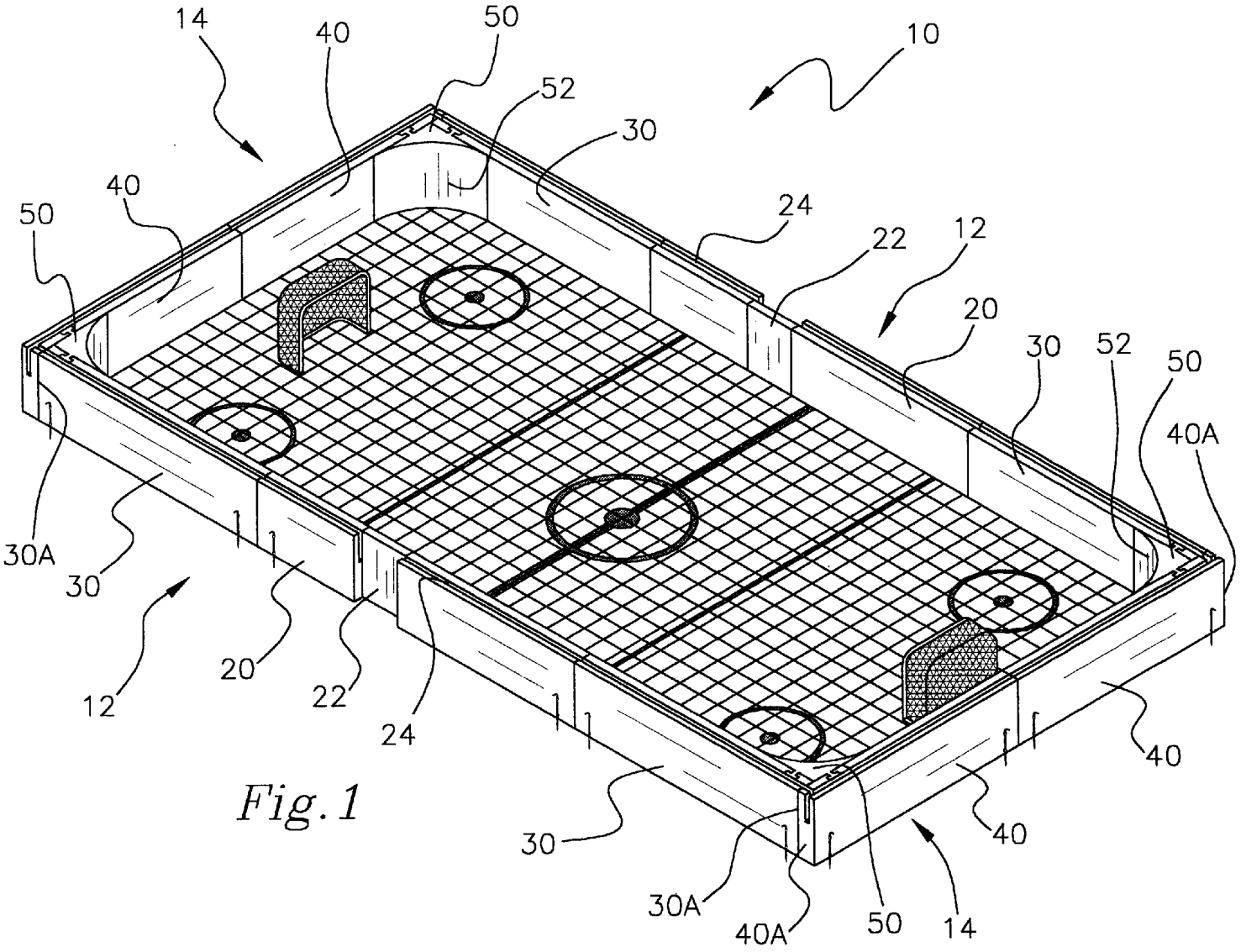
FIG. 1 is a perspective view of a new modular rink assembly according to the present invention.
Figure 2:
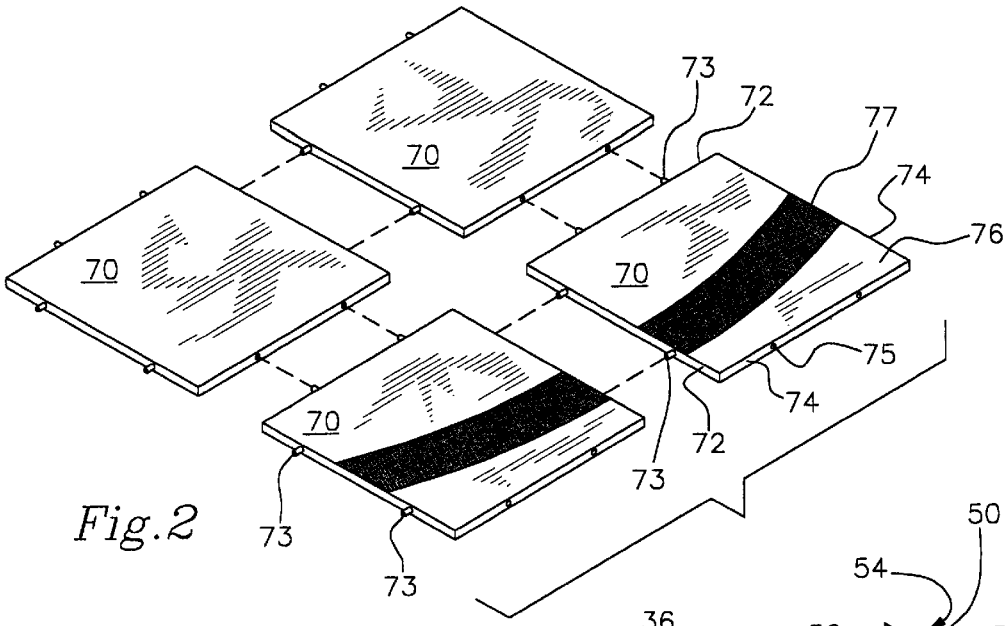
FIG. 2 is an exploded perspective view of the interconnectable floor boards.
Figure 3:
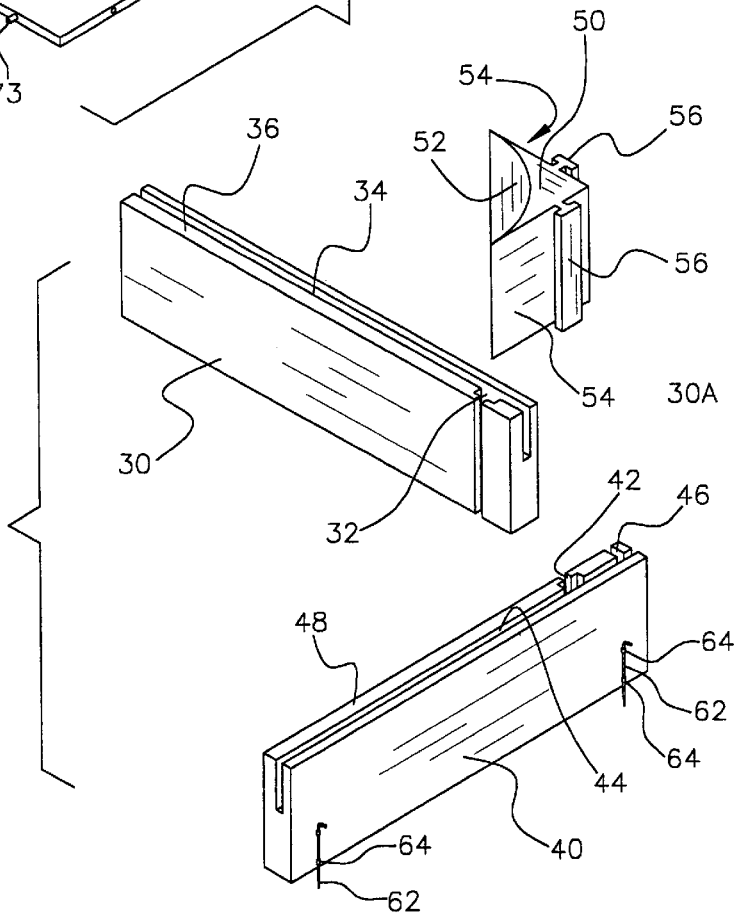
FIG. 3 is a top right front side exploded perspective view of the corner connection of the modular rink assembly.

With reference now to the drawings, and in particular to FIGS. 1 through 3 thereof, a new modular rink assembly embodying the principles and concepts of the present invention and generally designated by the reference numeral 10 will be described.

As best illustrated in FIGS. 1 through 3, the modular rink assembly 10 comprises two sets of side boards 12 and two sets of end boards 14. Each set of side boards 12 including a medial side board 20 and two outer side boards 30. Each medial side board 30 has a door panel 22 for allowing a user to pass through the door panel to enclosed area 16. Each set of end boards 14 includes two outer end boards 40.

Each outer side board 30 has a substantially vertical T-shaped slot 32 positioned proximate an outermost edge 30A of each respective outer side board 30. Similarly, each outer end board 40 has a substantially vertical T-shaped slot 42 positioned proximate an outermost edge 40A of each respective outer end board 40.

The sets of side boards 12 are positionable opposite each other and the sets of end boards 14 are positionable at opposite ends of the sets of side boards 12 to form an enclosed area.

Corner members 50 each have a rounded face 52 and a pair of substantially vertical planar faces 54. A T-shaped flange 56 is disposed from each planar face 54 for insertion into a respective one of said T-shaped slots 32 and 42 whereby adjacent outer end boards 40 and outer side boards 30 are held in place with respect to each other.

Floor panels 70 are positioned over the ground and between said sets of side boards 12 and end boards 14 for providing a substantially uniform playing surface within the enclosed area.

each of the outer end boards 40, outer side boards 30, and medial boards 20 have engagement means 64 positioned at opposite ends of the outer end boards 40, outer side boards 30, and medial boards 20. Posts 62 attach to each engagement means 64 and are inserted into the ground so the outer end boards 40, outer side boards 30, and medial boards 20 are held substantially in place.

The floor panels further include spaced dowels 73 extending from two adjacent sides 72 of each floor panel, and holes 75 in opposite adjacent sides 74 such that each of the floor panels are matable with each other to form a playing surface in the enclosed area while preventing the displacement of adjacent floor panels during play.

Each outer side boards 30 and said medial boards 20 also includes a lengthwise side board groove 34 and 24, respectively, in an upper surface 36 and 26, respectively, for facilitating attachment of containment panels extending up from said outer side boards 30 and medial boards 20.

Each of the outer end boards 30 includes a lengthwise end board groove 44 in an upper surface 48. The end board groove 44 is also adapted for facilitating attachment of containment panels extending up from the outer end boards 40. Each of the outer end boards 30 further have a transverse groove 46 running from an inner face 41 of each respective outer end board 40 to said end board groove 44, said transverse groove 46 is positioned to align with the side board grooves 24 and 34 when said sets of side boards 12 and end boards 14 are assembled to form the enclosed area. The floor panels also include indicia 77 positioned on a top surface 76 of the floor panels 70 such that the floor panels can be arranged such that the indicia 77 define a playing surface having demarcations on the playing surface corresponding to a selected game to be played.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A modular rink assembly comprising:

two sets of side boards, each set of side boards including a medial side board and two outer side boards, said outer side boards being positioned on opposite sides of said medial side board, each medial side board having a door panel for allowing a user to pass through said door panel when said door panel is in an open position;

two sets of end boards, each set of end boards including two outer end boards;

each said outer side board and each said end board having a substantially vertical respective T-shaped slot positioned proximate an outermost edge of each respective outer side board and each respective end board;

said sets of side boards being positionable opposite each other, said sets of end boards being positionable at opposite ends of said sets of side boards and extending between said sets of side boards to form an enclosed area;

a plurality of corner members, each of said plurality of corner members having a rounded face, each of said corner members further having a pair of substantially vertical planar faces; and a T-shaped flange disposed from each said planar face, each said T-shaped flange being for insertion into a respective one of said T-shaped slots whereby adjacent outer end boards and outer side boards are held in place with respect to each other, and whereby said corner members provide rounded corners for said enclosed area.

2. The modular rink assembly of claim 1, further comprising:

a plurality of floor panels, said plurality of floor panels being adapted for positioning over the ground and between said sets of side boards and end boards, said floor panels being for providing a substantially uniform playing surface within said enclosed area.

3. The modular rink assembly of claim 2, further comprising:

each of said outer end boards, said outer side boards, and said medial boards having engagement means for engaging a post, said engagement means being positioned at opposite ends of said outer end boards, said outer side boards, and said medial boards; and a plurality of posts for engaging said engagement means, said posts being further adapted for insertion into the ground whereby said outer end boards, said outer side boards, and said medial boards are held substantially in place.

4. The modular rink assembly of claim 2 wherein said floor panels further comprise:

a plurality of spaced dowels extending from two adjacent sides of each said floor panel; and said floor panels being structured to have a plurality of spaced holes in two adjacent sides opposite said dowels, said holes being for mating with said dowels of an adjacently placed one of said floor panels such that said plurality of floor panels are matable with each other to form said playing surface, said dowels and holes further being for preventing the displacement of adjacent floor panels during play.

5. The modular rink assembly of claim 4, wherein said floor panels include indicia positioned on a top surface of said floor panels such that said plurality of floor panels is arrangeable into a playing surface such that said indicia define a playing surface having the indicia for playing a game having rules requiring demarcations on the playing surface.

6. The modular rink assembly of claim 5, wherein the demarcations on the playing surface are for playing the game of hockey.

7. The modular rink assembly of claim 1, wherein each of said outer side boards and said medial boards further includes a lengthwise side board groove in an upper surface adapted for facilitating attachment of containment panels extending up from said outer side boards and medial boards;

said outer end boards each include a lengthwise end board groove in an upper surface of each said outer end board adapted for facilitating attachment of containment panels extending up from said outer end boards; and each of said outer end boards further being structured to have a transverse groove running from an inner face of each respective outer end board to said end board groove, said transverse groove being positioned to align with said side board grooves when said sets of side boards and end boards are assembled to form said enclosed area.

8. A modular rink assembly comprising:

two sets of side boards, each set of side boards including a medial side board and two outer side boards, said outer side boards being positioned on opposite sides of said medial side board, each medial side board having a door panel for allowing a user to pass through said door panel when said door panel is in an open position;

two sets of end boards, each set of end boards including two outer end boards;

each said outer side board and each said end board having a substantially vertical respective T-shaped slot positioned proximate an outermost edge of each respective outer side board and each respective outer end board;

said sets of side boards being positionable opposite each other, said sets of end boards being positionable at opposite ends of said sets of side boards and extending between said sets of side boards to form an enclosed area;

a plurality of corner members, each of said plurality of corner members having a rounded face, each of said corner members further having a pair of substantially vertical planar faces; and a T-shaped flange disposed from each said planar face, each said T-shaped flange being for insertion into a respective one of said T-shaped slots whereby adjacent outer end boards and outer side boards are held in place with respect to each other, and whereby said corner members provide rounded corners for said enclosed area;

a plurality of floor panels, said plurality of floor panels being adapted for positioning over the ground and between said sets of side boards and end boards, said floor panels being for providing a substantially uniform playing surface within said enclosed area;

each of said outer end boards, said outer side boards, and said medial boards having engagement means for engaging a post, said engagement means being positioned at opposite ends of said outer end boards, said outer side boards, and said medial boards;

a plurality of posts for engaging said engagement means, said posts being further adapted for insertion into the ground whereby said outer end boards, said outer side boards, and said medial boards are held substantially in place;

wherein said floor panels further comprise:

a plurality of spaced dowels extending from two adjacent sides of each said floor panel, and said floor panels being structured to have a plurality of spaced holes in two adjacent sides opposite said dowels, said holes being for mating with said dowels of an adjacently placed one of said floor panels such that said plurality of floor panels are matable with each other to form said playing surface, said dowels and holes further being for preventing the displacement of adjacent floor panels during play;

said door panels being openable to permit access to said enclosed area;

each of said outer side boards and said medial boards further including a lengthwise side board groove in an upper surface, said side board groove being adapted for facilitating attachment of containment panels extending up from said outer side boards and medial boards;

said outer end boards each including a lengthwise end board groove in an upper surface of each said outer end board, said end board groove being adapted for facilitating attachment of containment panels extending up from said outer end boards;

each of said outer end boards further being structured to have a transverse groove running from an inner face of each respective outer end board to said end board groove, said transverse groove being positioned to align with said side board grooves when said sets of side boards and end boards are assembled to form said enclosed area;

wherein said floor panels include indicia positioned on a top surface of said floor panels such that said plurality of floor panels is arrangeable into a playing surface such that said indicia define a playing surface having the indicia for playing a game having rules requiring demarcations on the playing surface; and wherein the demarcations on the playing surface are for playing the game of hockey.

* * * * *